United States Patent [19]

Negita et al.

[11] 4,368,776

[45] Jan. 18, 1983

[54] ALUMINUM HEAT EXCHANGER

[75] Inventors: Junichi Negita, Hekinan; Yuichiro Yamada, Kariya; Hideaki Kaneko, Tokyo; Takao Ogino, Yokohama, all of Japan

[73] Assignees: Nippondenso Co., Ltd., Kariya; Nihon Pakerizing Co., Ltd., Tokyo, both of Japan

[21] Appl. No.: 272,765

[22] Filed: Jun. 11, 1981

[30] Foreign Application Priority Data

Jun. 17, 1980 [JP] Japan ..... 55/81882

[51] Int. Cl.[3] ..... F28F 19/02

[52] U.S. Cl. ..... 165/133; 165/180; 428/650

[58] Field of Search ..... 165/133, 134 R, 134 DP, 165/180, DIG. 8; 428/650

[56] References Cited

U.S. PATENT DOCUMENTS

| | | | |
|---|---|---|---|
| 3,050,786 | 8/1962 | John et al. | 165/180 X |
| 3,650,005 | 3/1972 | Kamiya et al. | 165/180 X |
| 4,193,180 | 3/1980 | Press | 165/180 X |

FOREIGN PATENT DOCUMENTS

| | | | |
|---|---|---|---|
| 3011497 | 10/1980 | Fed. Rep. of Germany | 165/133 |
| 46-6847 | 2/1971 | Japan . | |
| 53-23548 | 7/1978 | Japan | 165/180 |

OTHER PUBLICATIONS

Inhibiting Corrosion, Bartkus et al., IBM Technical Disclosure Bulletin, vol. 13, No. 7, Dec. 1970, p. 1764.

*Primary Examiner*—Albert W. Davis, Jr.
*Attorney, Agent, or Firm*—Cushman, Darby & Cushman

[57] ABSTRACT

An aluminum heat exchanger with excellent corrosion resistance and particularly suited for adaptation as radiator for automobiles, the heat exchanger having a 2- or 3-layer coating film structure consisting of a zinc-diffused layer formed on the surface of an aluminum base and a waterproof organic film formed on the zinc-diffused layer with or without a phosphoric acid-chromate coating therebetween, whereby the surface of the aluminum base is not directly contacted with at least the water-containing heat exchange medium is provided.

9 Claims, 5 Drawing Figures

ALUMINUM HEAT EXCHANGER

This invention relates to an aluminum-made heat exchanger which can be conveniently adapted, for example, as a heat exchanger for cooling automobile engine (generally called a radiator), a heat exchanger for a hot water type car heater, a heat exchanger for a water circulation type air-conditioner for the domestic use and other wide variety of industrial heat exchangers. More particularly, this invention provides an aluminum-made heat exchanger protected against the corrosion by a water containing heat exchange medium and amazingly improved in corrosion durability.

BACKGROUND OF THE INVENTION

For the purposes of weight reduction and manufacturing cost reduction, aluminum is being prevalently used instead of conventional brass for the production of heat exchangers, particularly those for automobiles. However, an aluminum-made heat exchanger is vulnerable to corrosion at its interior side which contacts with a heat exchange medium, particularly when water is contained in the heat exchange medium, and such corrosion would lead to the leakage of the heat exchange medium.

Such corrosion is attributed to the use of service water as the heat exchange medium, which service water usually contains some ions, typically such as chlorine ions, which promote the corrosion of an aluminum material.

It has been generally practised, therefore, to add a corrosion inhibitor (generally called a rust preventive) to the water-containing heat exchange medium, but the corrosion inhibitory effect of such corrosion inhibitor varies greatly depending on its concentration, and there has often been found no effect. Thus, the use of a corrosion inhibitor is not deemed as an effective measure against corrosion. Japanese Patent Publication No. 6847/71 discloses a method for forming an anti-corrosive coating on an aluminum or aluminum-alloy base, but his patent is directed to the corrosive environment as seen in beverage industries and it is not applicable to the prevention of corrosion of such a heat exchanger as a radiator for automobiles, as contemplated in this invention.

SUMMARY OF THE INVENTION

The object of this invention is to provide an aluminum-made heat exchanger characterized by forming a zinc-diffused layer on the interior surface of an aluminum tube constituting a heat exchanger and, furthermore, forming thereon a water-proof resin coating film having a coating thickness of at least 3μ, so that the water-containing heat exchange medium will not directly contact with the aluminum tube surface to thereby realize the elongation of the corrosion-resisting life of the heat exchanger.

It is another object of this invention to provide an aluminum-made heat exchanger in which a phosphoric acid-chromate coating film is formed between said zinc-diffused layer and water-proof resin coating to further prolong the corrosion-resisting life of the heat exchanger.

The fundamental idea for preventing the corrosion of aluminum-made heat exchangers according to this invention consists in the formation of a zinc-diffused layer. Since this zinc-diffused layer is inferior in its natural electrode potential to the aluminum material, it is corroded sacrificially in the use of the heat exchangers. The resulting corrosive pits grow gradually, but they do not advance inwardly but expand sidewise to corrode the zinc-diffused layer alone.

Thus, according to this invention, the aluminum base is prevented from corrosion by the sacrificial corrosion of the zinc-diffused layer.

However, the formation of such zinc-diffused layer alone on the aluminum base does not give a satisfactory solution to the corrosion problem in a practical use, because there takes place the rapid elution of zinc concommitant to the sacrificial corrosion of the diffused layer, as this diffused layer is constantly in contact with the heat exchange medium. Also, corrosion products formed as a result of the elution of zinc and aluminum deposit on the interior surface of a heat exchanger tube and obstruct the circulation of the heat exchange medium or lower the heat dissipating effect.

According to this invention, in order to arrest such elution of the zinc-diffused layer, the surface of said diffused layer is coated with a water-proof resin film so that said zinc-diffused layer and aluminum base cannot directly contact the heat exchange medium to thereby inhibit the advance of corrosion.

If said resin coating is formed directly on the aluminum base without forming the zinc-diffused layer, the resin coating is liable to be damaged or peel off in case alien matters get into the heat exchange medium due to the poor adhesiveness of the resin coating film to the aluminum base in a corrosive environment, resulting in a reduced corrosion inhibitory performance.

According to this invention, it is suggested to form a phosphoric acid-chromate film on the zinc-diffused layer on the aluminum base and then further form thereon a water-resistant resin coating. This can further enhance the aluminum base protective effect against corrosion.

The zinc-diffused layer on the surface of the aluminum base protects the aluminum base from corrosion by its sacrificial anodic action, while the phosphoric acid-chromate film on said zinc-diffused layer not only serves as a protective film for the aluminum base in a corrosive environment, but also strengthens the adhesion of the resin coating, when such resin coating is formed on the phosphoric acid-chromate film, as said resin coating can fastly attach to said film. Thus, the formation of said phosphoric acid-chromate film can minimize the risk of peeling of the resin coating thereby making the protection of the aluminum base from corrosion more effective.

In this invention, the depth of diffusion of the zinc-diffused layer into the aluminum base should preferably be at least 10μ. If such depth of diffusion is less than 10μ, aluminum corrosion becomes easier to advance thereby causing pitting.

Also, in this invention, the thickness of the resin coating needs to be at least 3μ. If such thickness is less than 3μ, no satisfactory corrosion inhibitory effect is provided by such resin coating. On the other hand, too large a coating thickness represents poor economy and also has an adverse effect on the heat dissipation. FIG. 3 is a diagram illustrating the relationship between resin coating thickness and heat dissipation. In the case of radiators for automobiles, the tolerance limit of reduction of heat dissipating performance is about 5% when the heat dissipating performance of aluminum per se (with no coating) is given as 100%. In the case of FIG.

3, such 5% reduction is caused when the resin coating thickness is 20μ. However, the given value of 20μ for the coating thickness is but a mere exemplification, and it is variable widely depending on the type of the heat exchanger involved. Thus, from the viewpoint of the satisfactory corrosion inhibitory effect, the resin coating thickness must be at least 3μ and is not subject to any specific definition for its upper threshold. The heat dissipation is rated by determining the difference between the inlet and outlet temperatures of a radiator.

In this invention, both the thickness and weight of the phosphoric acid-chromate film are not absolutely important factors; the object of this invention can be well accomplished if such phosphoric acid-chromate film is provided to cover the surface of the zinc-diffused layer to a certain extent.

It is an essential requirement for the resin coating of this invention to have at least a water resistance. Either thermoplastic or thermosetting resins may be used as the material for constituting such coating. Exemplary of such resin materials are a vinyl chloride-vinyl acetate copolymer, vinylidene chloride-vinyl chloride copolymer, modified vinyl resin obtained by modifying the vinyl chloride-vinyl acetate copolymer with a phenol resin, epoxy resin, etc., thermosetting vinyl resin obtained by adding an amino resin to said vinyl chloride-vinyl acetate copolymer, vinyl-organo resin obtained by dispersing powders of vinyl chloride resins, etc., in a solvent, alcohol-soluble thermosetting phenol resin and other epoxy resins such as a butyral resin, modified phenol resin, epoxy-amino resin, epoxy-phenol resin, epoxy-polyamide resin, epoxy-ester resin, etc., oil varnish, thermosetting acrylic resin and fluorine resin.

Figure 1:
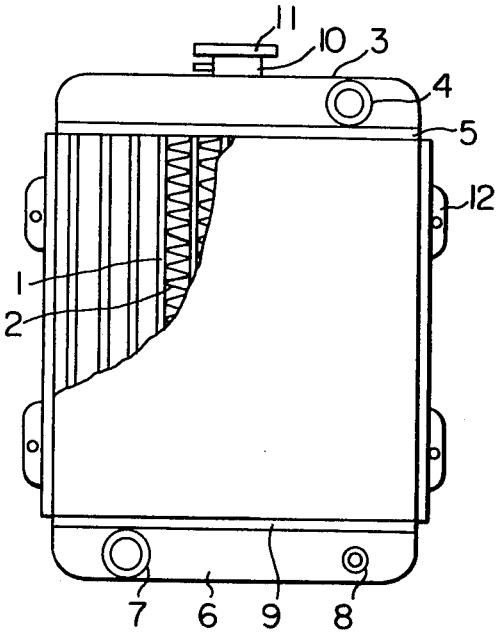
FIG. 1 is a frontal view of an embodiment of the heat exchanger constituted by the tubes according to this invention.

The aluminum-made heat exchanger according to this invention has a structure schematically illustrated in FIG. 1. In this invention, all of tanks 3 and 6, inlet pipe 4 and outlet pipe 7 may be made of aluminum or may be constructed as a monoblock with a thermosetting resin.

Figure 2A:
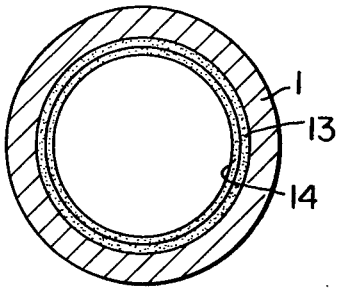
FIG. 2A is a sectional view of tube 1 shown in FIG. 1.
Figure 2B:
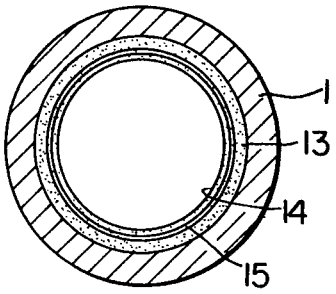
FIG. 2B is a sectional view of tube 1 in another embodiment of this invention.
Figure 3:
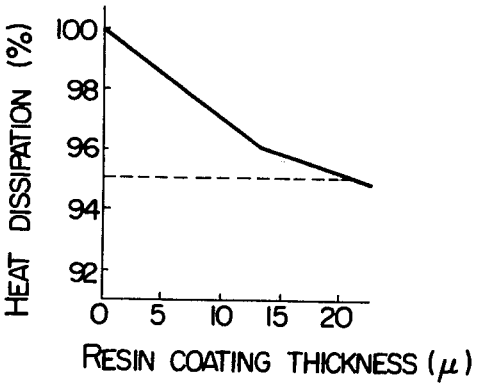
FIGS. 3 and 4 are characteristic diagrams for illustrating this invention.

In the case of the resin monoblock, the aluminum-made tube 1, aluminum-made fin 2 and aluminum-made core plates 5 and 9 are joined by vacuum brazing or by ordinarily brazing in a furnace to construct a monoblock core assembly. On the interior surface of the tube 1 and core plates 5 and 9 of said core assembly there is formed a two-layer coating structure consisting of zinc-diffused layer 13 and resin coating 14, as shown in FIG. 2A, or a three-layer coating structure consisting of zinc-diffused layer 13, phosphoric acid-chromate film 15 and resin coating 14, as shown in FIG. 2B, and then the integral resin-made tanks 3 and 6 are mechanically caulked and secured to the respective core plates 5 and 9.

In said assembly, the fin 2 may not necessarily be of a corrugate form; they may be plate-shaped or may be an integral skived fin assembly shaped by directly skiving the external surface of the tube 1. In using the plate-shaped fin 2, it may be mechanically combined with the tube 1 by expanding the outer diameter of the tube 1 according to a pipe expanding method. This method may be applied to assemblage of the tube 1 and core plates 5 and 9.

In assembling all the parts by mechanical means, as mentioned above, without using any brazing techniques, the two-layer or three-layer coating is previously formed on the interior surface of the tube 1 and core plates 5 and 9. In the case of heat exchangers of a type having no said core plates 5 and 9, said coating may be formed on the interior surface of the tube 1 alone. In the drawings, reference numeral 10 indicates an aluminum-made water feed port, 11 a cap and 12 a fixing bracket.

In this invention, in forming said coating on the inside of the heat exchanger, it is recommended to forcedly circulate a treating solution through the tanks 3 and 6 and tube 1. In this case, no loss of the treating solution is suffered, as there occurs no deposition of the treating solution on the outside of the heat exchanger.

The term "aluminum material" includes aluminum or aluminum alloys in this invention.

This invention is illustrated in further detail hereinbelow by way of some embodiments of this invention and some comparative examples, but this invention should not be restricted to these embodiments.

EXAMPLES 1 AND 2

Figure 4:
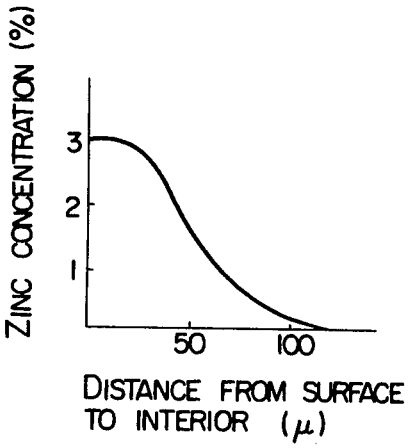

Each test plate piece of aluminum AA-3004 (0.4 mm in thickness and 40 mm×100 mm in size) used for an aluminum-made heat exchanger tube was dipped for 30 seconds in an aqueous 60° C. cleaning fluid having dissolved therein 20 g/l of a weakly alkaline cleaner (trade name: Fine Cleaner, from NIHON PAKERIZING CO., LTD.) for degreasing and cleaning, and then washed with water. This degreased and cleaned test piece was then dipped in an aqueous 30° C. treating solution having dissolved therein 30 g/l of a chemical zinc plating agent (trade name: Precoat T 500, from NIHON PAKERIZING CO., LTD.) and then washed with water to form a coating with a metallic zinc deposition of 1 g/m$^2$, on the test piece. The thus treated test piece was then placed stationary in a 550° C. hot oven for 10 minutes to effect the thermal diffusion of metallic zinc into the aluminum plate of the test piece. The surface zinc concentration was about 3% by weight and the depth of the diffused layer was about 100μ, and a concentration distribution was resulted in, as shown in FIG. 4. The concentration distribution diagram of FIG. 4 was obtained as a result of the linear analysis of a section of the test piece by an electron probe microanalyzer (EPMA).

The test piece formed with said zinc-diffused layer was dipped in an epoxy-phenol type clear lacquer solution (trade name: Prepalene 4032, from NIHON PAKERIZING CO., LTD.) adjusted in concentration by a solvent (a resin solid content: 20 by weight). Then the lacquer deposit on the test piece was subjected to dryng by a hot air circulation type oven at 200° C. for 15 minutes to form the epoxy-phenol type resin coatings of 3μ and 5μ in thickness on the respective test pieces.

COMPARATIVE EXAMPLE 1

The same treatment as in Examples 1 and 2 was repeated, except that the epoxy-phenol type resin coating was 1μ thick.

COMPARATIVE EXAMPLES 2 AND 3

Epoxy-phenol type resin coatings of 3μ and 5μ thick were formed directly on respective test pieces by following the same procedure as in Examples 1 and 2, except that no zinc-diffused layer was formed. The resin coating material and the aluminum plate used for each test piece were the same as employed in Examples 1 and 2.

COMPARATIVE EXAMPLE 4

No treatment was given to a test piece.

EXAMPLES 3 AND 4

Each test piece formed with a zinc-diffused layer by the same method and treating agent as used in Examples 1 and 2 was dipped in an aqueous 50° C. phosphoric acid-chromate treating solution (trade name: Bonderite 701, AB agent: 48 g/l and AC agent: 2.7 g/l, from NIHON PAKERIZING CO., LTD.) for 3 minutes, then washed with water and dried. The quantitative analysis of each test piece by fluorescent X-ray diffraction showed the formation of a phosphoric acid-chromate coating with a chromium deposit of 0.4–0.5 g/m$^2$.

The respective test pieces formed with said phosphoric acid-chromate coating film were further treated to form an epoxy-phenol resin coating with a thickness of 3μ and 5μ, respectively, by the same method and lacquer solution as used in Example 1.

COMPARATIVE EXAMPLE 5

The same treatment as in Examples 4 and 5 was repeated, except that the epoxy-phenol type resin coating was 1μ thick.

COMPARATIVE EXAMPLES 6 AND 7

The degreased and cleaned test pieces used in Examples 1 and 2 were dipped in the same 50° C. phosphoric acid-chromate treating solution as employed in Examples 3 and 4 for 3 minutes, then washed with water and dried. Each of these test pieces was formed with a phosphoric acid-chromate coating with a chromium deposit of 0.4–0.5 g/m$^2$.

Then said test piece was dipped in the same epoxy-phenol type clear lacquer solution as used in Examples 1 and 2 and further treated in the same way as in Examples 1 and 2 to form an epoxy-phenol type resin coating with a thickness of 3μ and 5μ, respectively, on the phosphoric acid-chromate coating film.

COMPARATIVE EXAMPLE 8

A phosphoric acid-chromate coating film was formed directly on a test piece in the same way as in Comparative Examples 6 and 7, except that no epoxy-phenol type resin coating was formed.

COMPARATIVE EXAMPLES 9–11

Coating operations were carried out in the same way as in Comparative Examples 6 and 7, except that an aqueous 50° C. chromic acid-chromate treating solution (trade name: Bonderite 713, 72 g/l, from NIHON PAKERIZING CO., LTD.) was used instead of the phosphoric acid-chromate treating solution and that each test piece was dipped in said treating solution for 5 minutes.

In these Comparative Examples 9–11, since each test piece was dipped in a chromic acid-chromate treating solution, a chromic acid-chromate coating with a chromium deposit of 0.3 g/m$^2$ (determined by the quantitative analysis by the fluorescent X-ray diffraction) was formed on the test piece.

COMPARATIVE EXAMPLE 12

A chromic acid-chromate coating film was formed directly on a test piece according to the same treatment as in Comparative Examples 9–11, except that no epoxy-phenol resin coating was formed.

COMPARATIVE EXAMPLES 13–15

A treating solution was prepared by using an aqueous 50° C. zinc phosphate treating solution (trade name: Bonderite D#170, 126 g/l, from NIHON PAKERIZING CO., LTD.) instead of the phosphoric acid-chromate treating solution, and to said solution there were further added 10 g/l of Promoter 170, 2.4 g/l of Promotor 171 and 20 g/l of Neutralizer 270, and by using this treating solution each test piece was subjected to the same resin coating forming treatment as in Comparative Examples 6 and 7, except that each test piece was dipped in said treating solution for 3 minutes.

In these Comparative Examples 13–15, a zinc phosphate coating with a coverage of 4–5 g/m$^2$ was formed on each test piece.

COMPARATIVE EXAMPLE 16

A zinc phosphate coating as formed directly on a test piece according to the same treating method as in Comparative Examples 13–15, except that no epoxy-phenol resin coating was formed.

COMPARATIVE EXAMPLE 17

On a test piece which has been degreased and cleaned in the same manner as in Examples 1 and 2, a zinc-diffused layer was formed by using the same treating solution and method as in Examples 1 and 2.

In this comparative example, neither dipping in the treating solution nor resin coating-forming treatment was performed.

COMPARATIVE EXAMPLE 18

A test piece which has been degreased and cleaned in the same manner as in Examples 1 and 2 was treated by using the same treating solution and method as in Examples 1 and 2 to form a zinc-diffused layer. On this zinc-diffused layer was further formed a chromic acid-chromate film by using the same treating solution (chromic acid-chromate treating solution) and method as in Comparative Examples 9–11. Then a 3μ thick epoxy-phenol resin coating was formed thereon by using the same lacquer solution and method as in Examples 1 and 2.

COMPARATIVE EXAMPLE 19

On a test piece which has been degreased and cleaned in the same manner as in Examples 1 and 2, a zinc-diffused layer was formed by the same treating solution and method as in Examples 1 and 2. Then a zinc phosphate coating film was formed on said zinc-diffused layer by using the same treating solution ( zinc phosphate treating solution) and method as in Comparative Examples 13–15.

In this comparative Example, no epoxy-phenol resin coating was formed.

EXAMPLE 5

The same process as in Examples 1 and 2 was repeated, except that the zinc diffusing treatment was carried out at 500° C.

The depth of zinc diffusion was 80μ and the thickness of the epoxy-phenol resin coating was 5μ.

EXAMPLE 6

The process of Examples 1 and 2 was repeated, except that the zinc diffusing treatment was carried out at 500° C. for 5 minutes. The depth of zinc diffusion was 30μ and the thickness of the epoxy-phenol resin coating was 5μ.

EXAMPLE 7

The process of Examples 1 and 2 was repeated, except that the zinc diffusing treatment was carried out at 450° C. for 25 minutes. The depth of zinc diffusion was 15μ and the thickness of the epoxy-phenol resin coating was 5μ.

EXAMPLE 8

The process of Examples 1 and 2 was repeated, except that the zinc diffusing treatment was carried out at 400° C. for 50 minutes. The depth of zinc diffusion was 10μ and the thickness of the epoxy-phenol resin coating was 5μ.

COMPARATIVE EXAMPLE 20

The process of Examples 1 and 2 was repeated, except that no zinc diffusing treatment was carried out. The depth of zinc diffusion was less than 10μ and the thickness of the epoxy-phenol resin coating was 5μ.

EXAMPLES 9–11

The process of Examples 1 and 2 was repeated, except that a vinyl chloride resin, a thermosetting acrylic resin and a fluorine resin were used, respectively, as the resin coating materials.

COMPARATIVE EXAMPLE 21

The process of Examples 1 and 2 was repeated, except that an amino-alkyd resin was used as a resin coating material.

The test pieces of Examples 1–11 and Comparative Examples 1–21 described above were tested according to a corrosion promoting test method described below.

For the evaluation of the test pieces, each test piece was immersed after the test in a solution having dissolved therein 50% by volume of a nitric acid solution having a concentration of 67% to remove the corrosion product, and then the depth of pitting was measured by a microscope (100 magnifications). The test results are shown in Table 1.

CORROSION PROMOTING TEST METHOD 750 ml of a corrosive liquid containing 1,000 ppm of $Cl^-$ ions ($NaCl+CuCl_2$), 1,000 ppm of $HCO_3^-$ ions ($NaHCO_3$), 1,000 ppm of $SO_4^{2-}$ ions ($Na_2SO_4$) and 10 ppm of $Cu^{2-}$ ions ($CuCl_2$) are put into a beaker, and each said test piece is immersed in this corrosive liquid. At the top of the beaker is provided a cooling pipe which connects into said beaker. Also connected to the beaker is an air supply pipe embedded in the corrosive liquid. The corrosive liquid temperature is maintained at 80±2° C. for 8 hours, while supplying air from the air supply pipe at a rate of 0.4 l/min., and then the air supply is stopped and the corrosive liquid temperature is maintained at 40±2° C. for 16 hours. Thereafter, the corrosive liquid temperature is again raised to 80±2° C. and maintained at this temperature for 8 hours. A similar operation is repeated five times (five days), and then the corrosive liquid temperature is maintained at 40±2° C. for 48 hours (with no air supply). This constitutes one cycle of operation, and this cycle of operation is repeated.

Beside the above-mentioned corrosion promoting test, a similar test was also conducted on the cut test pieces. This test was conducted by giving a knife cut reaching the aluminum base in the resin coating of each of the test pieces of Examples 1–13, Comparative Examples 2 and 3, 6 and 7, 9–11, 13–15, 20 and 21 and subjecting each of these cut test pieces to the above-mentioned corrosion promoting test. The results are shown in Table 1.

As seen from Table 1, the test pieces of Examples 1 and 2, that is, the test pieces formed with a two-layer coating structure consisting of a zinc-diffused layer and a resin coating on the aluminum base, as tested according to said corrosion promotion test, are completely free of pitting and thus have very excellent corrosion resistance when the resin coating thickness is 3μ and 5μ. However, said test pieces with 1μ thick resin coating develops 0.1 mm pitting on the 12th cycle.

On the other hand, the test pieces with cut resin coating suffer fairly deep pitting (0.3 mm) when the resin coating thickness is 1μ (the plate thickness of each test piece is 0.4 mm), but the test pieces of 3μ and 5μ in thickness develop pitting of 0.2 mm and 0.15 mm in depth, respectively, which is a fairly good result.

The test pieces of Examples 3 and 4, namely, those having a three-layer coating structure having a phosphoric acid-chromate film sandwiched between the zinc-diffused layer and the resin coating show substantially the same effect as the test pieces of Examples 1 and 2 according to the corrosion promotion test conducted, but a prominent difference in the degree of corrosion turns up in the test pieces with a cut resin coating. Namely, the test pieces of Examples 3 and 4 with a cut resin coating remain free of any corrosive pitting when the resin coating thickness is 3μ or 5μ.

The test pieces of Comparative Examples 2 and 3, which are the ones on which a resin coating was formed directly, develop 0.3 mm deep pits even when the resin coating thickness is 5μ, and through-pits are formed when the coating thickness is 3μ. Formation of such through-pits is further encouraged when a cut is given to the resin coating.

These results dictate that no satisfactory effect is provided by merely forming a resin coating directly on the aluminum base.

Comparative Examples 6 and 7, 9–11 and 13–15 exemplify the combinations of phosphoric acid-chromate coating+resin coating, chromic acid-chromate coating+resin coating and zinc phosphate coating+resin coating, respectively. According to the said corrosion promoting test, these test pieces develop no pitting when the resin coating thickness is 5μ, but through-pits are formed when a cut is given to the resin coating.

It will be appreciated from these results that no significant effect is obtained from mere formation of a chemically treated film and a resin coating on the aluminum base.

Comparative Examples 8, 12 and 16 show the cases where a phosphoric acid-chromate coating, a chromic acid-chromate coating and a zinc chromate coating were respectively formed directly on the aluminum base. Through-pits are formed in all of these cases, indicating ineffectiveness of these examples.

Comparative Example 17 is a case where a zinc-diffused layer alone was formed on the aluminum base. It will be seen that, in this case, pitting turns up from the fourth cycle of the corrosion test, indicating no significant effect from mere formation of a zinc-diffused layer alone.

Comparative Example 18 presents a case where a chromic acid-chromate coating was formed instead of the phosphoric acid-chromate of Example 3. As is apparent from a comparison between Comparative Example 18 and Example 3, the test piece of Comparative Example 18 using a chromic acid-chromate is noticeably inferior in corrosion resistance to that of Example 3.

Comparative Example 19 is a case where a zinc-diffused layer and a zinc phosphate coating were formed on the aluminum base. In this case, corrosion resistance is similarly poor.

Comparative Example 4 represents a conventional example, in which no coating is formed on the aluminum base. It is noted that this example shows no corrosion resistance.

Examples 5–8 are intended to show how corrosion resistance is influenced by the diffusion depth of the zinc-diffused layer. As understood from Table 1, few pits are formed even if the diffusion depth is as small as 10μ. Absolutely no pit is formed when the diffusion depth is greater. On the other hand, if the diffusion depth is smaller than 10μ, as shown in Comparative Example 20, through-pits are produced when a cut is given to the resin coating.

Examples 9–11 were performed to observe the effect according to the difference in the resin coating material. It is seen that substantially the same good result as in the case of epoxy-phenol resin is obtained by using vinyl chloride resin, thermosetting acrylic resin and fluorine resin as a resin coating material.

It is also noted that no good result is obtained from Comparative Example 20 in which an amino-alkyd resin is used as a coating material. This is considered attributable to the poor water-resistance of the amino-alkyd resin.

In order to re-confirm the effects obtained in the above-mentioned tests, there was further carried out the following bench test.

A heat exchanger having the structure of FIG. 1 was assembled by using vacuum brazing techniques. This heat exchanger was cleaned including its inside (the interior of tube 1, tanks 3 and 6, etc.) with the above-mentioned commercially available cleaner "Fine Cleaner" and then water was injected into the inside of the heat exchanger for washing. An aqueous metallic zinc coating forming solution having dissolved therein 300 g/l of above-mentioned Precoat T-500, and this treating solution maintained at 30° C. was circulated through the inside of the heat exchanger. Thereafter, water was injected into the inside of the heat exchanger for washing and then the heat exchanger was placed stationary in a 550° C. hot oven to effect thermal diffusion of metallic zinc into the aluminum base of the heat exchanger.

This heat exchanger was dipped for 4 minutes in an aqueous 50° C. phosphoric acid-chromate treating solution having dissolved therein above-mentioned Bonderite 701, allowing entrance of said treating solution into the inside of the heat exchanger. Thereafter, the interior of the heat exchanger was washed with water and then dried in a drying oven of 90°–100° C.

After drying, the above-mentioned Prepalene 4032 was circulated in the interior of the heat exchanger and, after removing excessive resin, the resin coating was baked at 200° C. for 15 minutes by feeding hot air into the inside of the heat exchanger. The above-described process is here given as in Example 1.

There were also similarly prepared the following heat exchangers: one having no zinc-diffused layer (having a phosphoric acid-chromate coating and an epoxy-phenol resin coating) as in Comparative Example 1, one having no epoxy-phenol resin coating (having a zinc-diffused layer and a phosphoric acid-chromate coating) as in Comparative Example 2, one having no phosphoric acid-chromate coating (having a zinc-diffused layer and an epoxy-phenol resin coating) as in Example 2 and one to which no surface treatment has been given as in Comparative Example 3.

The above-mentioned corrosive liquid at 80° C. was circulated (at a flow rate of approximately 1 m/sec) in the interior of each of said heat exchangers for 8 hours and then said circulation was suspended (a flow rate was 0 m/sec) for 16 hours by lowering the liquid temperature to room temperature. This operation was set as one cycle, and each of said heat exchangers was subjected to a continuous 2,000-cycle test.

For the purpose of evaluation, the tube (a wall thickness was 0.4 mm) of each heat exchanger after the test was cut open and further cut to a predetermined size, and the cut piece was dipped in a solution having dissolved therein 50% by volume of 67% nitric acid to remove the corrosion products and then observed by a microscope (100 magnifications) to measure the number and depth of the pittings. The results are shown in Table 2.

As noted from Table 2, the heat exchangers of Examples 1 and 2 were perfectly free of pittings, indicating the very excellent corrosion resistance thereof. On the other hand, the heat exchangers of Comparative Examples 2 and 3 developed pittings and were obviously unsuited for practical use.

TABLE 1

| No. | Examples and Comparative Examples | Zinc diffusion: Heating condition | Zinc diffusion: Diffusion depth | Type of coating treatment | Resin coating: Type | Resin coating: Thickness | Pitting depth in corrosion promoting test (mm): 4 cycles | 8 cycles | 12 cycles | Pitting depth from the cut part (mm): 4 cycles | 8 cycles | 12 cycles |
|---|---|---|---|---|---|---|---|---|---|---|---|---|
| | Comparative Example | | | | | | | | | | | |
| 1 | 7 | | | Phosphoric acid chromate | Epoxyphenyl | 5 | 0 | 0 | 0 | 0.1 | 0.3 | K |
| | 6 | | | Phosphoric acid chromate | " | 3 | 0 | <0.1 | <0.1 | 0.1 | 0.2 | K |

TABLE 1-continued

| No. | Examples and Comparative Examples | Zinc diffusion: Heating condition | Zinc diffusion: Diffusion depth | Type of coating treatment | Resin coating: Type | Resin coating: Thickness | Pitting depth in corrosion promoting test (mm): 4 cycles | 8 cycles | 12 cycles | Pitting depth from the cut part (mm): 4 cycles | 8 cycles | 12 cycles |
|---|---|---|---|---|---|---|---|---|---|---|---|---|
| | 8 | | | Phosphoric acid chromate | | | 0.3 | K | K | | | |
| 2 | 9 | | | Chromic acid-chromate | " | 5 | 0 | 0 | 0 | 0.2 | K | K |
| | 10 | | | Chromic acid-chromate | " | 3 | 0 | 0 | 0 | 0.2 | K | K |
| | 11 | | | Chromic acid-chromate | " | 1 | K | K | K | 0.2 | K | K |
| | 12 | | | Chromic acid-chromate | | | K | K | K | | | |
| 3 | 13 | | | Zinc phosphate | " | 5 | 0 | 0 | 0 | 0.1 | K | K |
| | 14 | | | Zinc phosphate | " | 3 | 0 | 0.1 | K | 0.1 | K | K |
| | 15 | | | Zinc phosphate | " | 1 | 0.3 | K | K | 0.1 | K | K |
| | 16 | | | Zinc phosphate | | | K | K | K | | | |
| 4 | 3 | | | | " | 5 | 0 | 0 | 0.3 | K | K | K |
| | 2 | | | | " | 3 | 0.1 | 0.3 | K | K | K | K |
| | 4 | | | | " | | K | K | K | | | |
| 5 | 17 | 550° C. 10 min. | 100 | | | | <0.1 | 0.1 | 0.3 | | | |
| | 18 | 550° C. 10 min. | " | Chromic acid-chromate | " | 3 | <0.1 | 0.1 | 0.15 | | | |
| | 19 | 550° C. 10 min. | " | Zinc phosphate | | | <0.1 | 0.1 | 0.20 | | | |
| | Example | | | | | | | | | | | |
| 6 | 1 | 550° C. 10 min. | " | | " | 5 | 0 | 0 | 0 | 0 | 0.1 | 0.15 |
| | 2 | 550° C. 10 min. | " | | " | 3 | 0 | 0 | 0 | 0 | 0.2 | 0.2 |
| | Comparative Example | | | | | | | | | | | |
| | 1 | 550° C. 10 min. | " | | " | 1 | 0 | 0 | 0.1 | 0 | 0.3 | 0.3 |
| | Example | | | | | | | | | | | |
| 7 | 4 | 550° C. 10 min. | " | Phosphoric acid-chromate | " | 5 | 0 | 0 | 0 | 0 | 0 | 0 |
| | 3 | 550° C. 10 min. | " | Phosphoric acid-chromate | " | 3 | 0 | 0 | 0 | 0 | 0 | 0 |
| | Comparative Example | | | | | | | | | | | |
| | 5 | 550° C. 10 min. | " | Phosphoric acid-chromate | " | 1 | 0 | <0.1 | 0.15 | 0 | <0.1 | 0.2 |
| | Example | | | | | | | | | | | |
| 8 | 5 | 500° C. 10 min. | 80 | Phosphoric acid-chromate | " | 5 | 0 | 0 | 0 | 0 | 0 | 0 |
| | 6 | 500° C. 5 min. | 30 | Phosphoric acid-chromate | " | " | 0 | 0 | 0 | 0 | 0 | 0 |
| | 7 | 450 25 min. | 15 | Phosphoric acid-chromate | " | " | 0 | 0 | 0 | 0 | 0 | <0.1 |
| | 8 | 400 50 min. | 10 | Phosphoric acid-chromate | " | " | 0 | 0 | 0 | 0 | 0 | <0.1 |
| | Comparative Example | | | | | | | | | | | |
| | 20 | No heating | <10 | Phosphoric acid-chromate | " | " | 0 | 0 | 0 | 0 | K | K |
| | Example | | | | | | | | | | | |
| 9 | 9 | 550° C. 10 min. | 100 | Phosphoric acid-chromate | Vinyl chloride | 5 | 0 | 0 | <0.1 | 0 | <0.1 | 0.2 |
| | 10 | 550° C. 10 min. | " | Phosphoric acid-chromate | Thermo-setting acryl | 5 | 0 | 0 | <0.1 | 0 | 0 | 0.1 |
| | 11 | 550° C. 10 min. | " | Phosphoric acid-chromate | Fluorine resin | 15 | 0 | 0 | 0 | 0 | 0 | 0 |
| | Comparative Example | | | | | | | | | | | |
| | 21 | 550° C. 10 min. | " | Phosphoric acid-chromate | Amino-alkyd resin | 20 | 0 | 0.1 | 0.2 | <0.1 | 0.1 | 0.3 |

Notes:
(1) K means that through-pits were produced.
(2) X means that no test was conducted.

TABLE 2

| | Number of pittings (per heat exchanger) | Maximum pitting depth (mm) |
|---|---|---|
| Example 1 | No pitting | 0 |

TABLE 2-continued

| | Number of pittings (per heat exchanger) | Maximum pitting depth (mm) |
|---|---|---|
| Example 2 | No pitting (resin | 0 |

TABLE 2-continued

| | Number of pittings (per heat exchanger) | Maximum pitting depth (mm) |
|---|---|---|
| | coating was partly peeled off) | |
| Comparative Example 3 | 4 | 0.12 |
| Comparative Example 2 | 15 | 0.08 |

What is claimed is:

1. An aluminum heat exchanger comprising a plurality of aluminum tubes through which a heat exchange medium containing at least water is circulated, each of said tubes having its inner surface coated with a zinc-diffused layer and a water-proof resin coating of at least 3 $\mu$ in thickness formed on said zinc-diffused layer.

2. An aluminum heat exchanger according to claim 1, wherein the zinc-diffused layer has a depth of at least 10 $\mu$.

3. An aluminum heat exchanger according to claim 1, wherein the water-proof resin coating is made of an epoxy-phenol type resin and has a thickness of 3–5 $\mu$.

4. An aluminum heat exchanger according to claim 1, wherein the water-proof resin coating comprises a vinyl chloride-vinyl acetate copolymer, a vinylidene chloride-vinyl chloride copolymer, a modified vinyl type resin obtained by modifying a vinyl chloride-vinyl acetate copolymer with a phenol resin or an epoxy resin, a thermosetting vinyl type resin obtained by adding an amino resin to a vinyl chloride-vinyl acetate copolymer, a vinyl-organo resin obtained by dispersing powdered vinyl chloride resin in a solvent, an alcohol-soluble thermosetting phenol resin, an epoxy resin selected from a butyral resin, a modified phenol resin, an epoxy-amino resin, an epoxy-polyamide resin or an epoxy-ester resin, an oil varnish, a thermosetting acrylic resin or a fluorine resin.

5. An aluminum heat exchanger comprising a plurality of aluminum tubes through which a heat exchange medium containing at least water is circulated, each of said tubes having its inner surface coated with a zinc-diffused layer, a phosphoric acid-chromate coating film formed on said zinc-diffused layer and a water-proof resin coating of at least 3 $\mu$ in thickness formed on said phosphoric acid-chromate coating film.

6. An aluminum heat exchanger according to claim 5, wherein the zinc-diffused layer has a depth of at least 10 $\mu$.

7. An aluminum heat exchanger according to claim 5, wherein the phosphoric acid-chromate coating film is provided with a coverage of 0.4–0.5 g/m$^2$.

8. An aluminum heat exchanger according to claim 5, wherein the water-proof resin coating is made of an epoxy-phenol resin and has a thickness of 3–5 $\mu$.

9. An aluminum heat exchanger according to claim 5, wherein the water-proof resin coating comprises a vinyl chloride-vinyl acetate copolymer, a vinylidene chloride-vinyl chloride copolymer, a modified vinyl resin obtained by modifying a vinyl chloride-vinyl acetate copolymer with a phenol resin or an epoxy resin, a thermosetting vinyl resin obtained by adding an amino resin to a vinyl chloride-vinyl acetate copolymer, a vinyl-organo resin obtained by dispersing powdered vinyl chloride resin in a solvent, an alcohol-soluble thermosetting phenol resin, an epoxy resin selected from a butyral resin, a modified phenol resin, an epoxy-amino resin, an epoxy-phenol resin, an epoxy-polyamide resin or an epoxy-ester resin, an oil varnish, a thermosetting acrylic resin or a fluorine resin.

* * * * *